US008490813B2

(12) United States Patent
Leon

(10) Patent No.: US 8,490,813 B2
(45) Date of Patent: Jul. 23, 2013

(54) WASTE CONTAINER AND SEQUENTIAL LINER DEPLOYMENT METHOD

(75) Inventor: Gustavo Leon, Miami, FL (US)

(73) Assignee: Ambience Systems, Inc., Miami, FL (US)

( * ) Notice: Subject to any disclaimer, the term of this patent is extended or adjusted under 35 U.S.C. 154(b) by 644 days.

(21) Appl. No.: 12/543,819

(22) Filed: Aug. 19, 2009

(65) Prior Publication Data

US 2010/0206880 A1 Aug. 19, 2010

Related U.S. Application Data

(60) Provisional application No. 61/207,772, filed on Feb. 17, 2009.

(51) Int. Cl.
*B65F 7/00* (2006.01)
*B65F 1/06* (2006.01)
*B65D 25/00* (2006.01)

(52) U.S. Cl.
USPC ..... 220/87.2; 220/908.2; 220/495.07

(58) Field of Classification Search
USPC ..... 220/495.07, 495.11, 87.1, 87.2, 908.2, 220/908, 908.1, 495.06, 495.01, 495.08; 222/61, 222/635; 422/5, 187
See application file for complete search history.

(56) References Cited

U.S. PATENT DOCUMENTS 2,281,630 A * 5/1942 Southard ..... 220/87.2
3,300,082 A 1/1967 Patterson
3,451,453 A * 6/1969 Heck ..... 206/390
3,481,112 A 12/1969 Bourgeois
3,800,503 A * 4/1974 Maki ..... 53/390
4,037,778 A 7/1977 Boyle
4,349,123 A 9/1982 Yang
4,364,490 A * 12/1982 Lang et al. ..... 220/495.07
4,721,226 A 1/1988 Yurko
4,798,363 A 1/1989 Cortesi
4,850,507 A * 7/1989 Lemongelli et al. ..... 220/495.07
4,869,391 A 9/1989 Farrington
4,955,505 A * 9/1990 Battaglia ..... 220/495.07
5,115,935 A * 5/1992 Lemongelli ..... 220/495.07
5,405,041 A * 4/1995 Van Brackle ..... 220/495.07
6,814,249 B2 * 11/2004 Lin ..... 220/87.1
6,866,070 B2 3/2005 King et al.
7,516,865 B1 * 4/2009 Pierre ..... 220/87.1
7,878,359 B1 * 2/2011 Ko ..... 220/87.2
2006/0081632 A1 * 4/2006 Shieh ..... 220/87.1
2006/0137619 A1 * 6/2006 Dodman et al. ..... 119/163
2006/0210200 A1 9/2006 Mikanikian
2007/0272715 A1 * 11/2007 Sassoon ..... 222/649
(Continued)

*Primary Examiner* — Steven A. Reynolds
(74) *Attorney, Agent, or Firm* — Feldman Gale, P.A.; Richard Guerra; A. Robert Weaver

(57) ABSTRACT

A waste container and method of deploying liners in the waste container generally including one or more container side walls; a container partition structure having a liner passing port and dividing the container into a container waste chamber and a container liner chamber; a sequential plurality of liners provided within the liner chamber in such a way that each liner is linked to the next so that when the first liner in the sequence is pulled through the liner passing port, the next sequential liner is ready to be pulled into the waste container for use; and a motion-activated spray canister that discharges an antiseptic or fragrant mist or spray into the waste container each time a new liner is deployed.

6 Claims, 9 Drawing Sheets

U.S. PATENT DOCUMENTS

2008/0023505 A1* 1/2008 Sassoon ..... 222/645
2008/0175751 A1* 7/2008 Sun et al. ..... 422/5
2010/0264168 A1* 10/2010 Larabee ..... 222/162
2011/0073598 A1* 3/2011 Liscio et al. ..... 220/211
2011/0303664 A1* 12/2011 Nichols ..... 220/87.2

* cited by examiner

WASTE CONTAINER AND SEQUENTIAL LINER DEPLOYMENT METHOD

CROSS REFERENCE TO RELATED APPLICATIONS

This application claims the benefit under 35 U.S.C. §119 (e) of U.S. Provisional Application No. 61/207,772, filed on Feb. 17, 2009, the complete disclosure of which is incorporated herein by reference in its entirety.

FIELD OF THE INVENTION

The present invention relates generally to the field of waste containment and disposal.

BACKGROUND OF THE PRESENT INVENTION

There have long been liners in the form of flexible plastic bags for lining waste containers so that waste can be easily removed by removal of the filled liner, while the interior of the container remains reasonably clean. There are, however, several problem with current methods and devices for lining waste containers. For example, boxes of liners are not always at hand and must be found and retrieved; the liners must be pulled out of a separate box, taken to the waste container, inserted and cuffed over the rim; and a significant amount of time and energy is expended in expanding the liner outside of the container and subsequently securing the liner to rim of the container.

It is thus an object of the present invention to provide a method and apparatus whereby liners are incorporated into a container such that the liners can be sequentially deployed directly within the container with a single pull, and then simply cuffed over the container rim.

It is another object of the present invention to provide a waste container having a telescoping container side wall, so that the waste container can be telescopically reduced to a retracted configuration for compact transport and storage, and then telescopically extended to its full operating configuration.

Still another object of the present invention is to provide a waste container that automatically discharges an antiseptic or fragrant spray each time a new liner bag is deployed inside of the waste container.

SUMMARY OF THE PRESENT INVENTION

The present invention is generally comprised of a waste container having a plurality of container side walls; a container partition structure having a liner passing port, whereby said container partition structure divides the container into a container waste chamber and a container liner chamber; and wherein a sequential plurality of liners are linked together in a sequence within the container liner chamber so that the first liner in the sequence at least partially extends through the liner passing port to ready the waste container for use.

To line the waste container, a liner within the liner passing port is pulled into the waste container and secured in an open top configuration such as by cuffing the liner's open end over a waste chamber rim at the upper end of one or more of the container walls. When the liner is full of waste or other material, the open end of the liner is closed and the liner is pulled from the waste chamber. The sequential linking of the liners causes the liner being pulled out of the waste chamber to draw the next sequentially linked liner from the liner chamber through the liner passing port and into the waste chamber for deployment and mounting in the same way.

In a preferred embodiment of the present invention, every time a new sequentially linked liner bag is pulled up to take the place of the previously filled liner bag, an electric motor activates a spray discharge into the waste chamber. The discharge can be scented or un-scented, and can also have antiseptic qualities such as a germ or bacteria killing agent. Preferably, this spray discharge system is located inside of the container liner chamber.

The liner chamber may be accessed such as by removing a container bottom wall secured to one or more of the container side walls, or opening a door located on one or more of the container side walls. Such access to the interior of the liner chamber permits periodic replacement of the sequential plurality of linked liners, and permits the first liner in the sequence to once again be pulled through the liner passing port.

The liner chamber preferably is permanently incorporated into the waste container during container manufacture. In an alternative embodiment of the present invention, the liner chamber is provided separately as an aftermarket item, and is mounted to the lower end of a conventional waste container below the container bottom wall. In this embodiment, a liner passing port is cut through the conventional container's bottom wall, which, in turn, serves as the container partition.

DETAILED DESCRIPTION OF THE PREFERRED EMBODIMENTS

Figure 1:
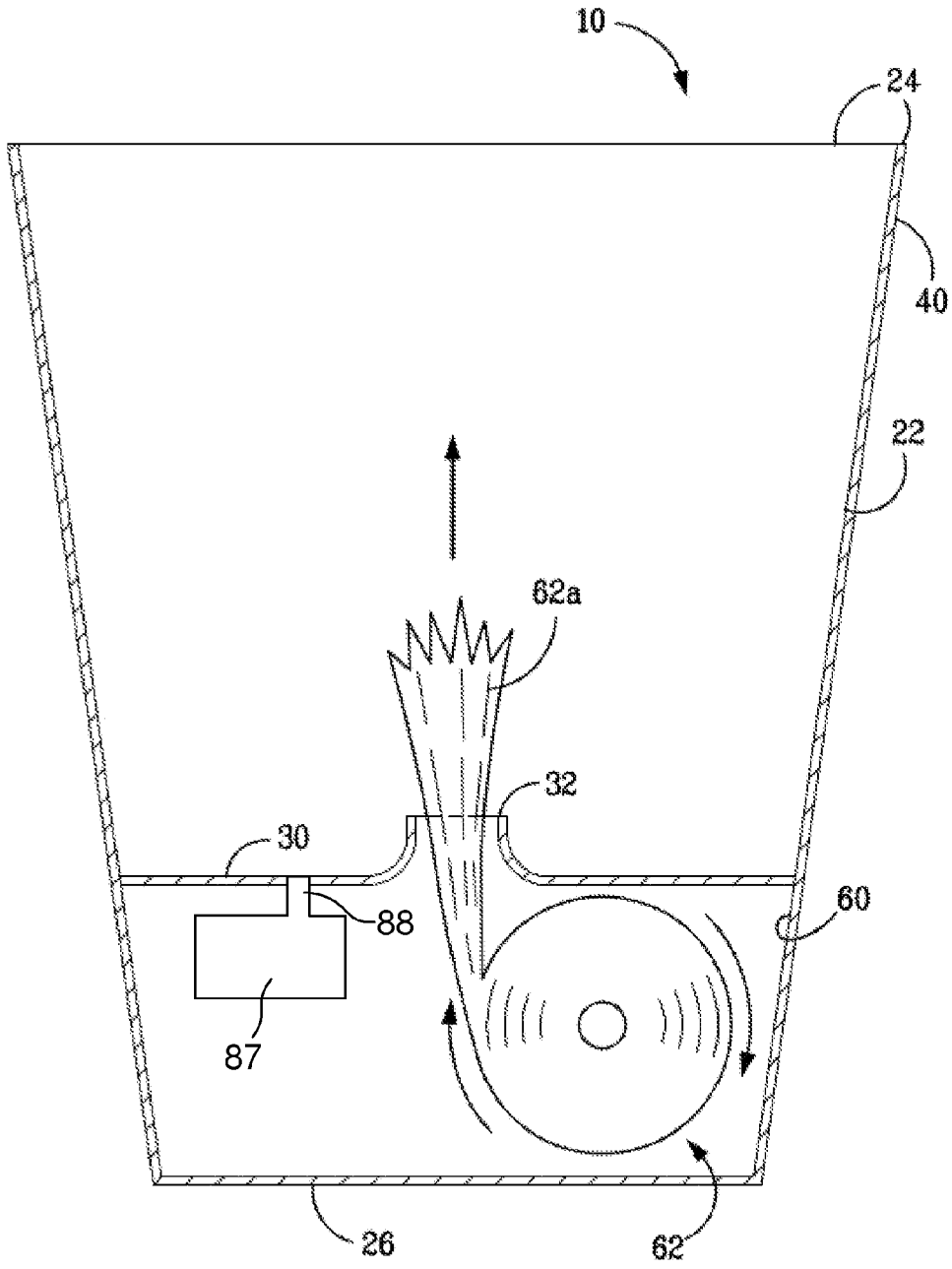
FIG. 1 depicts a side view of the waste container with a roll of liners connected one to the next.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to FIGS. 1-9, a waste container 10 is disclosed having one or more container side walls 22 and a container partition structure 30 having a liner passing port 32. Container partition 30 divides the container 10 into a container waste chamber 40 and a container liner chamber 60 having a sequential plurality of liners 62 provided within the liner chamber 60, each liner 62A being linked to the next liner 62B in the sequence, and whereby a first liner 62A in the sequence extends at least partially through the liner passing port 32 to ready the waste container 10 for use.

To line the waste chamber 10, a liner 62A extending through the liner passing port 32 is pulled into the waste chamber 40 and secured in an open top configuration such as by cuffing the liner's open end over a waste chamber rim 24 at the upper end of one or more of the container walls 22. When the liner 62A is full of waste or other material, the open end of the liner is closed and pulled from the waste chamber 40. Due to the sequential linking of the liners 62, while one liner 62A is pulled out of the waste chamber 10 the open end of a sequentially linked liner 62B is consequently drawn from the liner chamber 60, extends through the liner passing port 32, and extends into the waste chamber 40 for repeated deployment and mounting.

Figure 9:
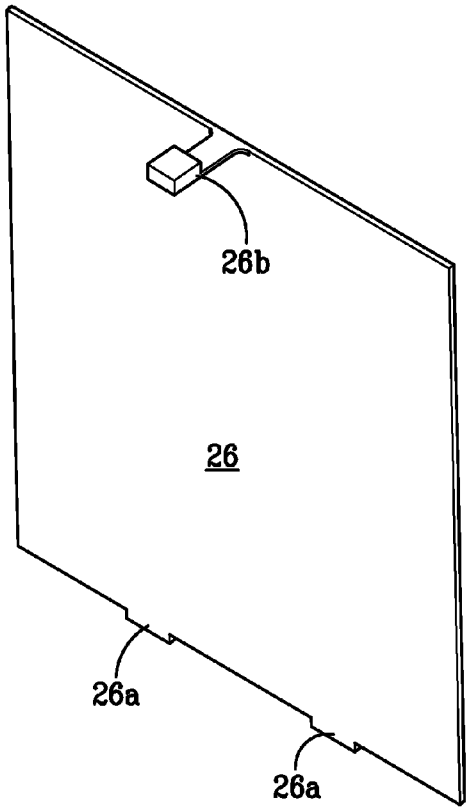
FIG. 9 depicts an embodiment of the bottom wall of the waste container.

Access to the interior of the liner chamber 60 permits periodic replacement of the sequential plurality of liners 62, and allows the first liner 62A in the sequence to once again be pulled through the liner passing port 32. In one embodiment of the present invention, the liner chamber 60 may be accessed by opening or removing the container bottom wall 26. Preferably, as shown in FIG. 9, the container bottom wall 26 can be secured to one or more of the container side walls 22 with protruding bottom wall hinge tabs 26A which are inserted into corresponding hinge tab notches (not shown) in the side wall 22 and with an opposing, releasable locking tab 26B which is also inserted into a corresponding locking tab notch (not shown) in the side wall 22. Alternative methods and structures known in the art for accessing the liner chamber 60 are also acceptable, such as a sliding or hinged door located on one or more of the side walls.

Preferably, the liner chamber 60 is permanently incorporated into the waste container 10. Alternatively, the liner chamber 60 is provided separately as an aftermarket item, and can be selectively mounted to and detached from the lower end of a conventional waste container below the conventional container's bottom wall. In this embodiment, a liner passing port 32 can be cut through the conventional container's bottom wall, whereby the bottom wall thus becomes the container partition 30.

The present container 10 may take any desired shape, including but not limited to a square, rectangular, circular or any other horizontal cross-sectional geometric configuration. A container top can also be provided on the present invention, including pivoting flat or fixed dome container lids (not shown). Alternatively, while the liner chamber 60 is preferably located at the lower end of container 10, it is contemplated that container 10 may be configured so that the liner chamber 60 is positioned beside or even above the waste chamber 40, for example.

Figure 2:
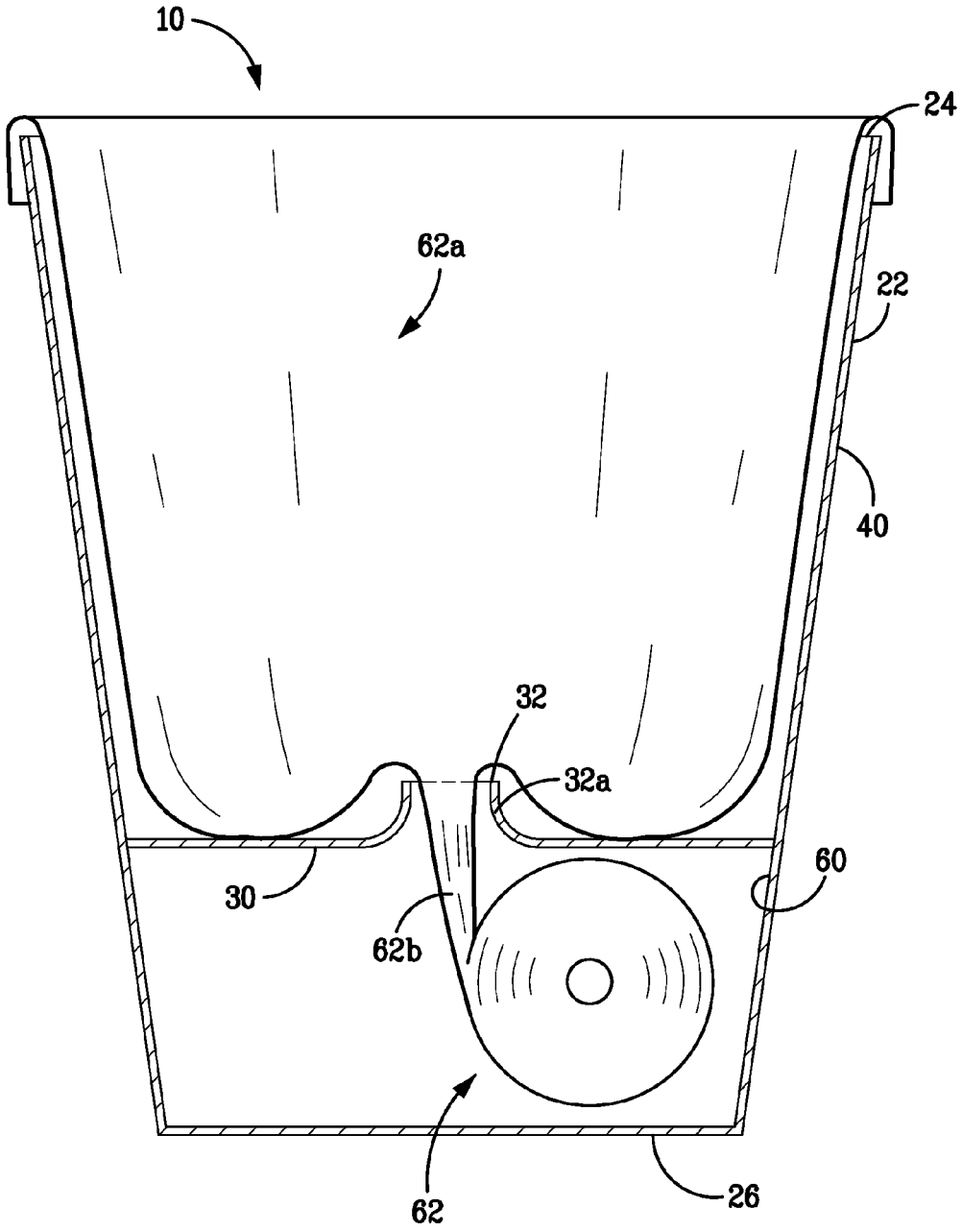
FIG. 2 depicts a side view of the waste container with a roll of liners connected one to the next, and a first of said liners being fully deployed in the waste container.
Figure 3:
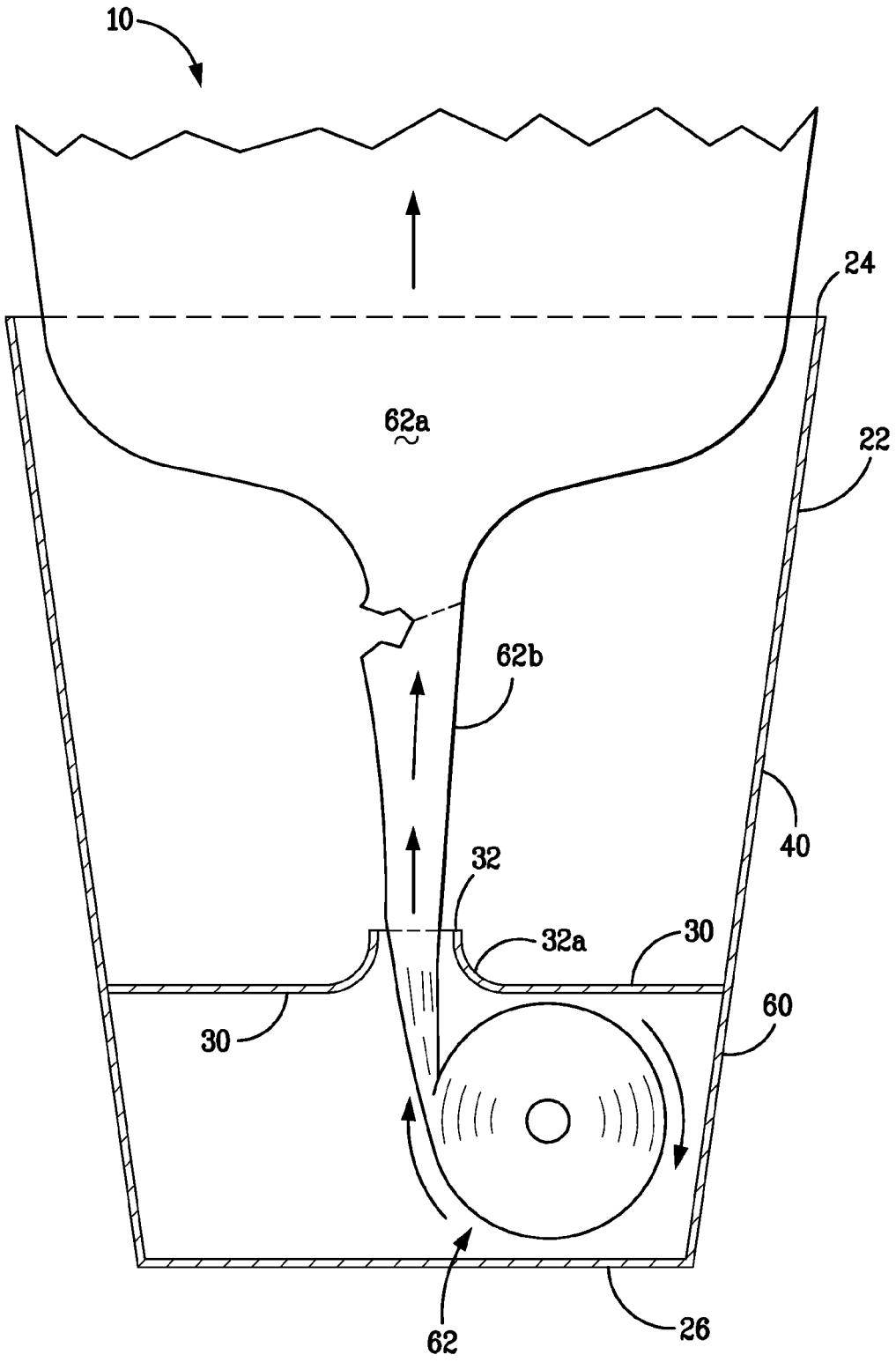
FIG. 3 depicts a side view of the waste container with a roll of liners connected one to the next, wherein a first of said liners is being removed from the waste container thereby causing a second of said liners to extend through the liner passing port.
Figure 4:
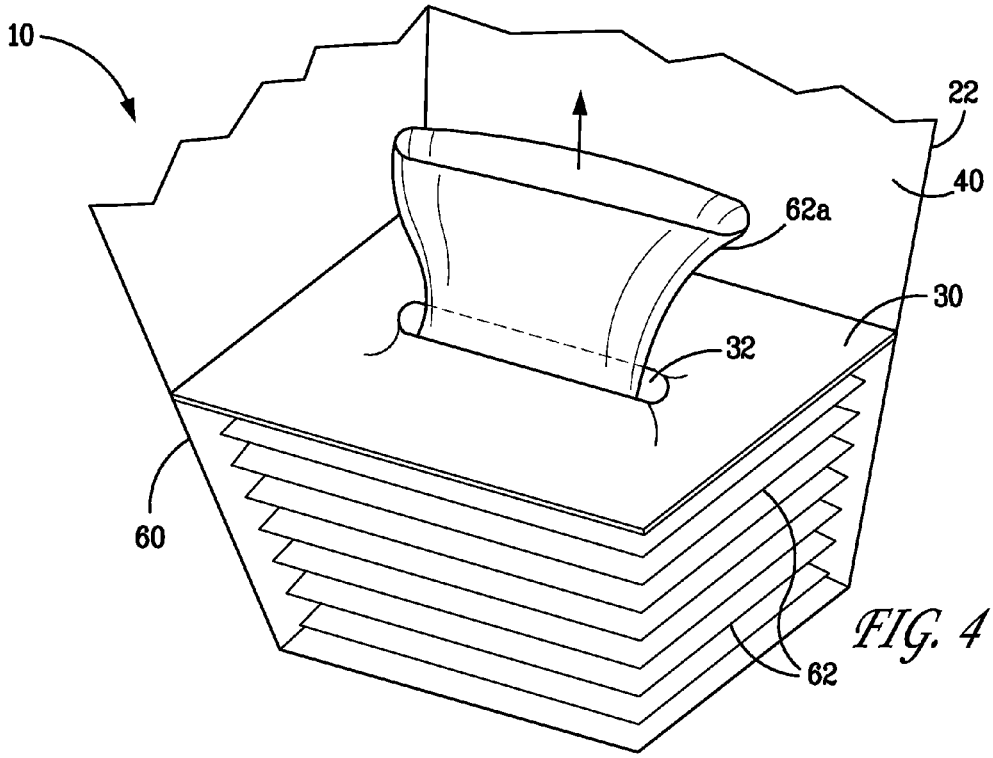
FIG. 4 depicts a perspective view of the waste container with a stack of liners folded to at least partially overlap each other one to the next.
Figure 5:
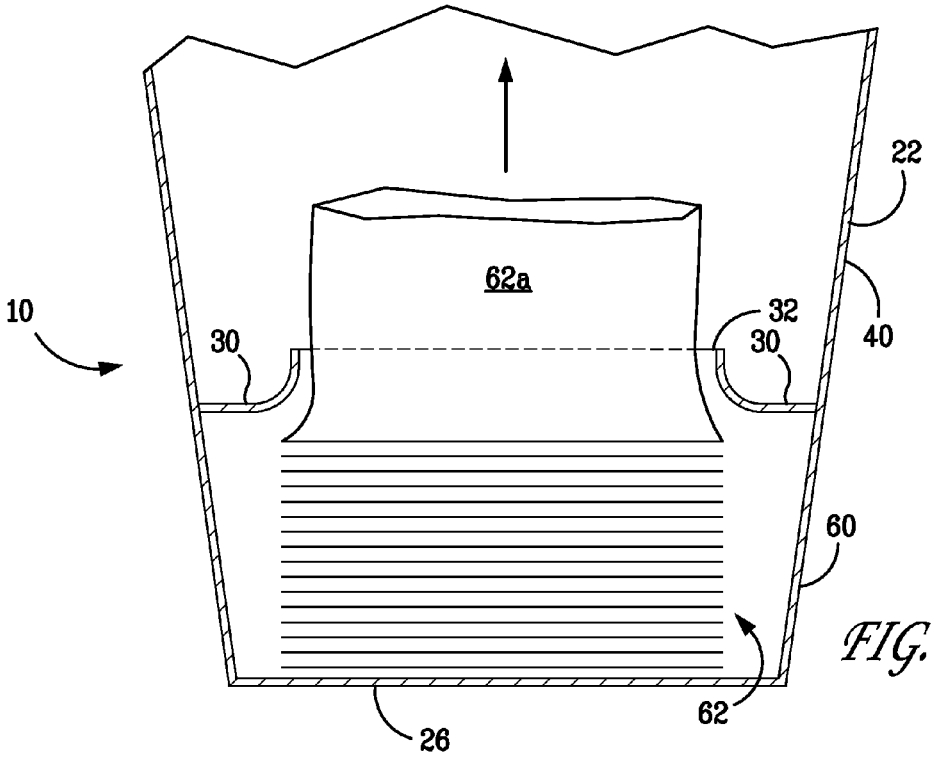
FIG. 5 depicts a side view of the waste container with a stack of liners folded to at least partially overlap each other one to the next.

As depicted in FIGS. 1 through 3, the sequential plurality of liners 62 preferably is a roll of liners connected one to the next by perforation tear lines. Alternatively, as depicted in FIGS. 4 and 5, the sequential plurality of liners 62 may be a stack of liners folded to at least partially overlap each other one to the next so that pulling one liner lifts the next liner in sequence. This particular embodiment resembles a stack of tissues contained in a dispensing box having a dispensing slot. As further depicted in FIGS. 4 and 5, in this embodiment, the liner passing port 32 can have a slot configuration.

Figure 7:
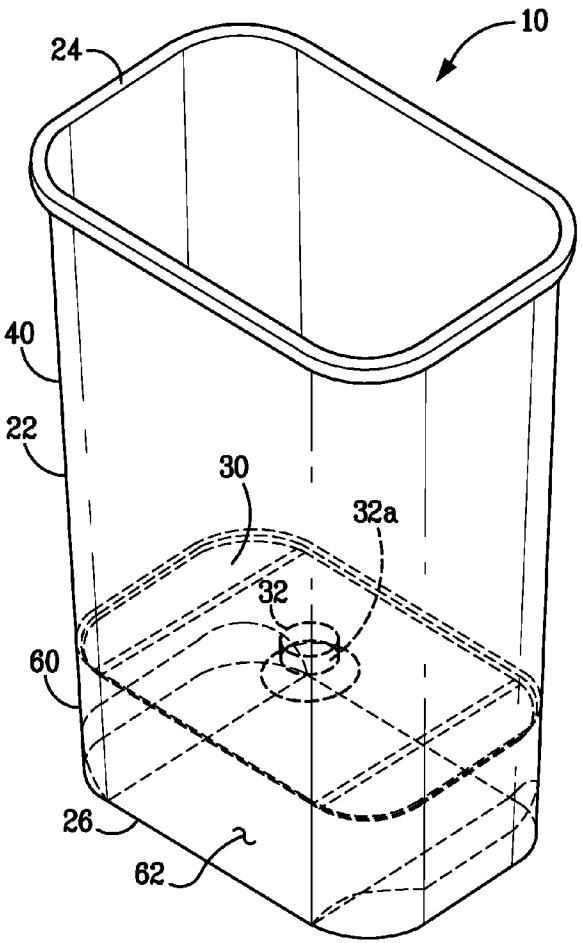
FIG. 7 depicts another perspective view of the waste container.

As depicted in FIG. 7, the container partition 30 preferably extends substantially horizontally across the interior of the container 10 to divide the container 10 into a lower liner chamber 60 below the partition 30 and an upper waste chamber 40 above the container partition 30, whereby the lower liner chamber 60 preferably has a container bottom wall 26 spaced several inches below the partition 30. The container partition 30 preferably is a panel joined at its perimeter to one or more of the container walls' 22 inner surfaces. In an alternative embodiment, the container partition 30 can be comprised of intersecting sets of heavy wires. Generally, the container partition 30 may be any structure suitable for supporting the closed end of a liner 62 that has been filled to capacity, while providing a liner passing port 32 for sequential liner deployment.

Figure 8:
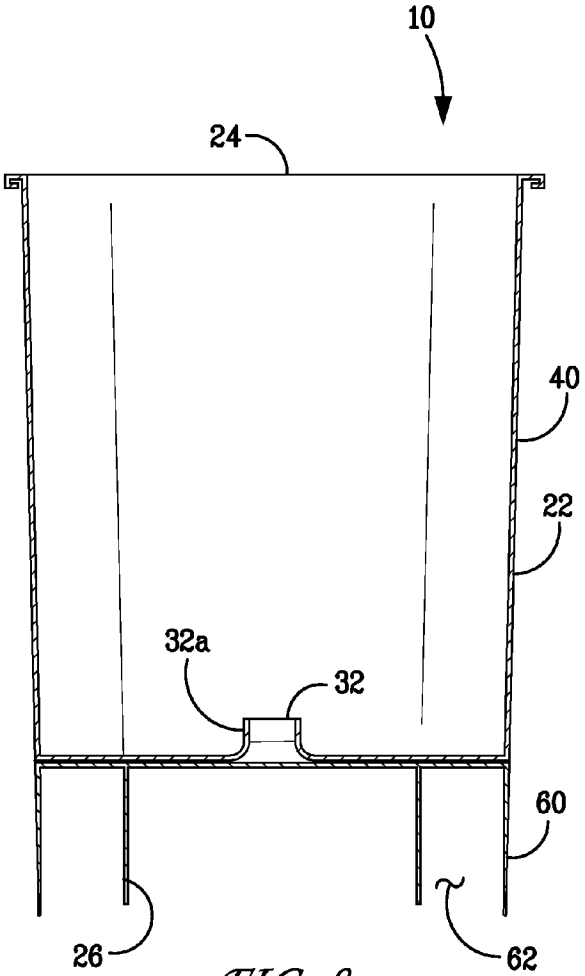
FIG. 8 depicts another side view of the waste container.
Figure 10:
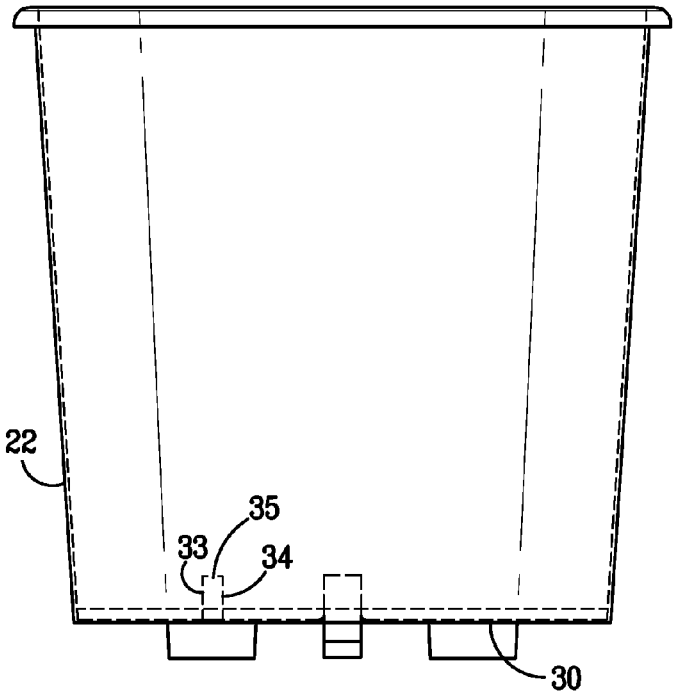
FIG. 10 depicts a side view of the expandable passageway embodiment of the liner passing port.

As depicted by FIG. 8, liner passing port flange 32A preferably extends upwardly along the perimeter of and fully around the liner passing port. Alternatively, as depicted in FIG. 10, the liner passing port is further comprised of an expandable passageway that not only provides access between the waste chamber and the liner chamber, but also prevents undesired fluids and solid trash from entering into the liner chamber. Preferably, the expandable passageway is comprised of one or more walls 33 and 34 that surround the perimeter of the liner passing port and extend vertically from the container partition 30. The upper edges of the passageway's one or more vertically extending walls 33 and 34 form a narrow opening 35 through which the liner bag can extend. Preferably, these one or more walls 33 and 34 taper narrowly as they extend from the container partition 30 to the narrow opening 35. These one or more walls can also be made of a flexible or semi-rigid material that allows that allows the passageway to flexibly extend when a liner bag is passed through the opening 35, and flexibly compress when the liner bag is stationary. Preferably, the expandable passageway is located near one or more of the container side walls 22 in order to minimize any interference or damage that may be caused by a filled container liner bag.

Figure 6:
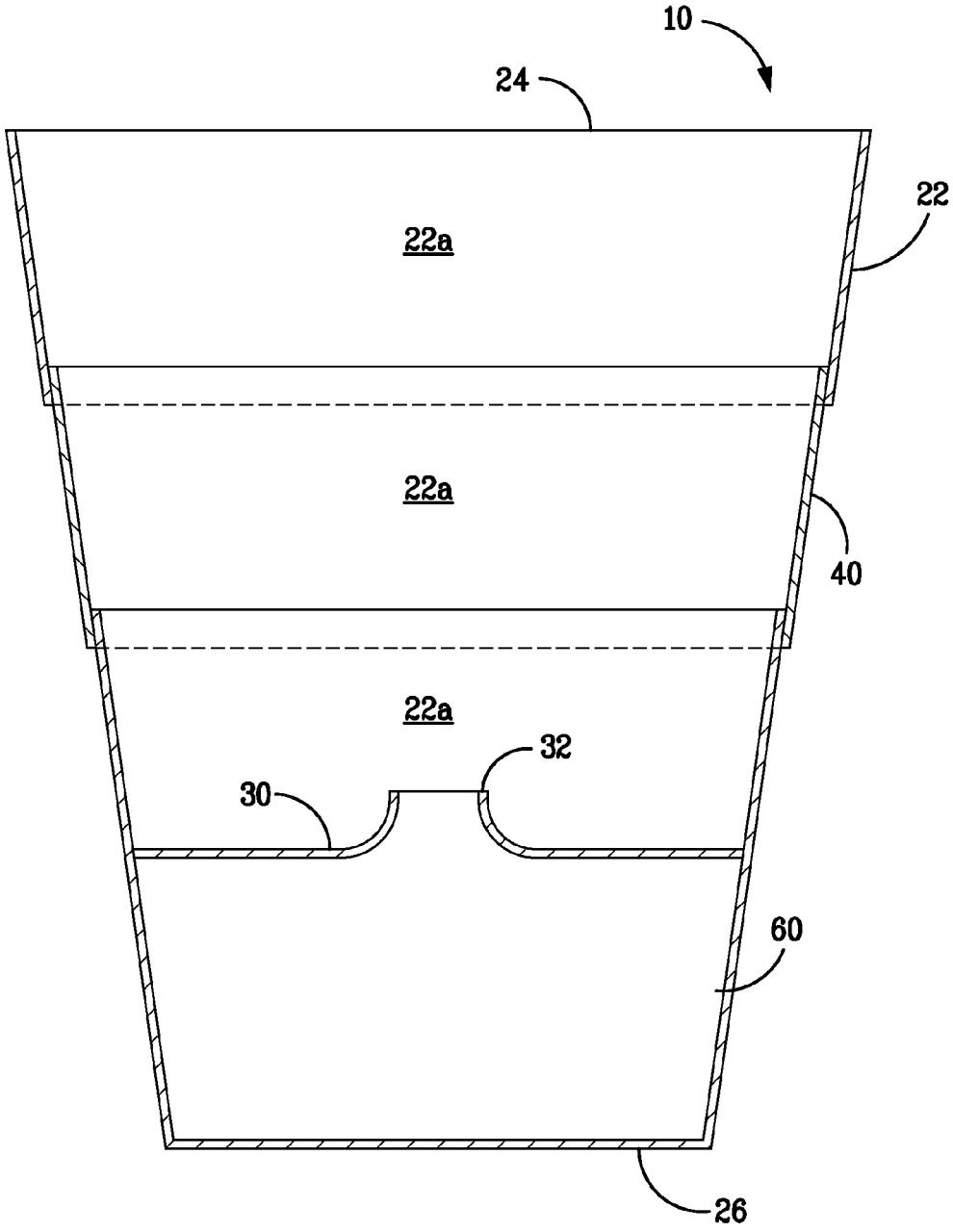
FIG. 6 depicts an alternative embodiment of the present invention, wherein the waste container's side walls are telescoping tubular segments beveled to snugly and sealingly lock together

As depicted in FIG. 6, in an alternative embodiment of the present invention, the container side walls 22, and specifically the portion of the container side walls 22 above the container partition 30, is formed of telescoping segments 22A beveled to snugly and sealingly lock together when pulled to full extension, and formed to telescopically collapse or bundle within each other into a compact configuration when retracted.

Figure 11:
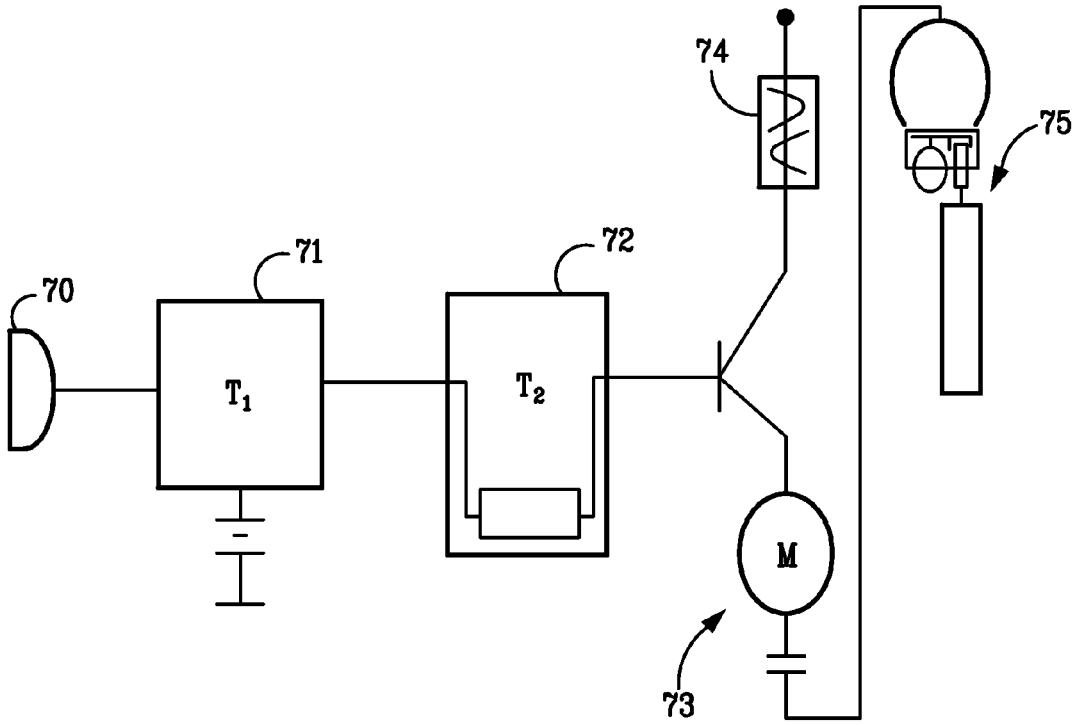
FIG. 11 depicts a diagram of the electric circuit for the discharge spray system.

In a preferred embodiment of the present invention, a motion-activated trigger causes a spray or mist to discharge into the waste chamber. The spray or mist can be scented or un-scented, and can also have antiseptic qualities such as a germ or bacteria killing agent. As schematically depicted in FIG. 11, a movement sensor 70, preferably located on the edge of the liner passing port, records the movement of the liner when the liner is being replaced. When the movement sensor records a movement, the sensor creates and transmits a digital signal to a first electronic circuit 71, herein referred to as a "temporizer," which subsequently creates and transmits a digital signal to a second temporizer 72. Preferably, the first temporizer 71 will only create and transmit a digital signal to the second temporizer 72 when the first temporizer receives two independent digital signals from the movement sensor 70 within a particular time span. For example, when the user removes a filled liner from the waste container, the sensor records a first movement, creates a digital signal, and transmits the signal to the first temporizer 71; the user subsequently deploys the next sequentially linked liner bag as described above, and the sensor records a second movement caused by replacing the previously removed liner, creates a digital signal, and transmits the signal to the first temporizer 71; if the first and second movement are recorded, and respective digital signals are created and transmitted to the first temporizer 71 within a pre-determined timeframe (preferably, the reasonable amount of time necessary to remove a filled liner bag and replace it with a sequentially linked liner bag, as described above), the first temporizer 71 will create and transmit a digital signal to the second temporizer 72. If, however, a second digital signal (created in response to a second recorded movement) is not transmitted to the first temporizer 71 within the predetermined timeframe, the first temporizer 71 will not transmit a digital signal to the second temporizer 72. Requiring the first temporizer 71 to receive two independent signals from the movement sensor 70 within a predetermined timeframe helps avoid undesired discharges, such as, for example, discharges caused when waste is deposited into the liner.

With further reference to FIG. 11, when the digital signal sent by the first temporizer 71 is received by the second temporizer 72, the second temporizer 72 creates a digital signal that determines the duration of time that the motor 73 will operate to activate the discharge mechanism 75, and will deliver this signal to the motor 73 and resistance 74 to generate sufficient power to activate the motor 73 for the amount of time pre-determined by the second temporizer 72. As disclosed in more detail below, preferably, the digital signal created by the second temporizer 72 will cause the discharge mechanism 75 to deliver a single discharge of an antiseptic or fragrant spray.

Figure 12:
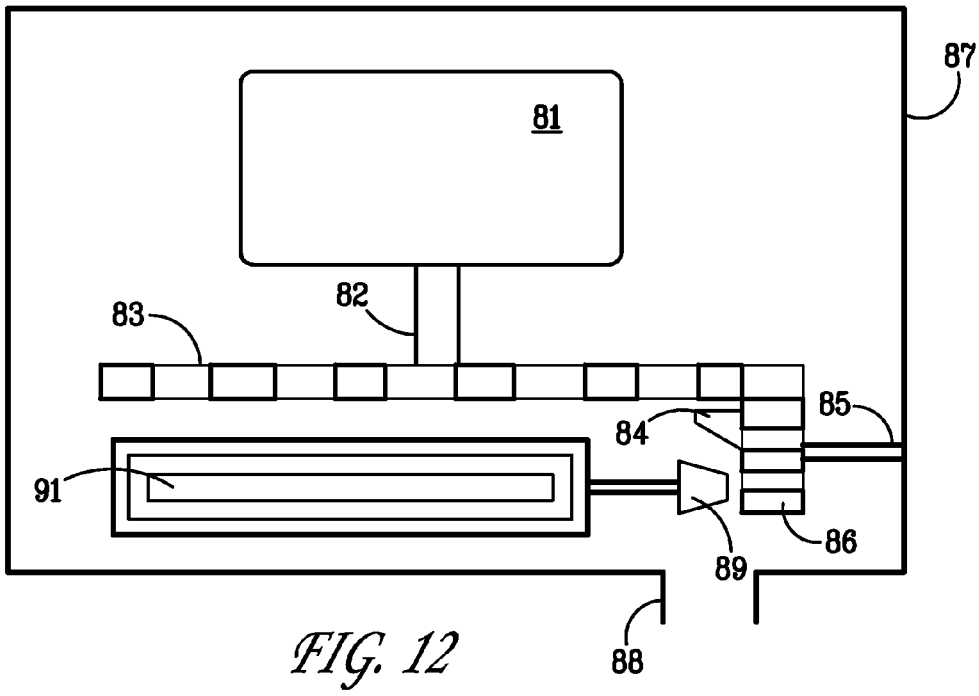
FIGS. 12 and 12*a* depict a close up view of one embodiment of the spray discharge mechanism.
Figure 12A:
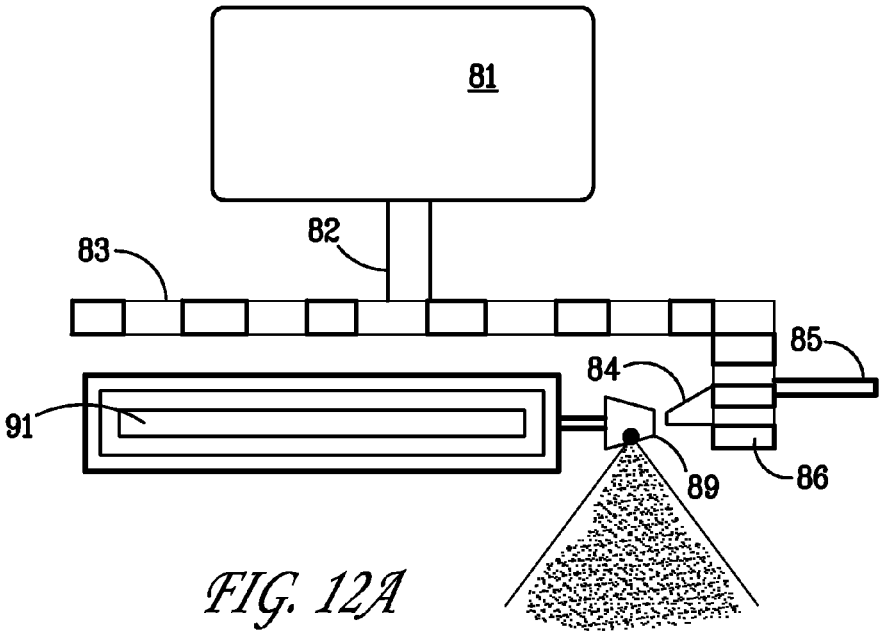

With reference to FIG. 12, in a preferred embodiment of the present invention, after the motor 81 and resistance receive a signal from the second temporizer, a power source delivers power to the motor 81 causing the motor's rotor 82 to rotate, thereby causing a first gear 83 attached to the rotor to also begin rotating. As depicted, the first gear 83 perpendicularly interlocks with a second gear 86 attached to a second rotor 85. As a result of the interlocking connection between the first and second gears 83 and 86, the rotation of the first gear 83 causes the second gear 86 to rotate. The second gear 86 is further comprised of a trigger 84 that protrudes from the face of the second gear 86. As the second gear rotates, the trigger 84 moves along a 360 degree arc. At one point along this 360 arc the trigger 84 contacts a depressible nozzle 89 attached to a pressurized canister 91 containing an antiseptic or fragrant fluid. As depicted in FIG. 12*a*, as the trigger 84 contacts and depresses the nozzle 89, it causes the nozzle to discharge fluid contained in the canister 91 as a spray or mist through a passageway 88 communicating with the interior of the container waste chamber 40. With further reference to FIG. 12, the motor 81, first and second gears 83 and 86, and canister 91 are all preferably contained within an enclosed canister housing 87, that can be configured to fit within the liner chamber.

It is specifically contemplated container 10 may be used for containing a wide variety of materials other than waste.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. A waste container comprising:

one or more container side walls;

a container partition having a liner passing port, said container partition dividing said container into a waste chamber and a liner chamber, the liner chamber dimensioned to receive a plurality of sequentially linked liners, the container partition dimensioned to permit passage of at least one of the liners of the plurality of sequentially linked liners from the liner chamber to the waste chamber when the plurality of sequentially linked liners are received in the liner chamber;

a canister housing provided within the liner chamber;

a passageway for fluid communication between the waste chamber and the canister housing; and a canister provided within the canister housing and having a pressurized fluid, the canister including a fluid discharge nozzle that discharges the fluid through the passageway and into the waste chamber as a spray or mist, the fluid discharge nozzle activated by a motion-sensing circuit, wherein the motion-sensing circuit includes a movement sensor positioned proximate to the liner passing port in order to detect movement at or proximate to the liner passing port, and wherein the motion-sensing circuit includes first and second temporizers, the first temporizer operable to transmit a first digital signal upon detection of movement by the movement sensor, the second temporizer operable to transmit a second digital signal upon an additional detection of movement by the movement sensor within a predetermined timeframe, the discharge of the fluid thereby occurring after the transmission of the second digital signal.

2. The waste container of claim 1, further comprising a motor and a trigger provided in the canister housing, the motor and trigger operable to open the fluid discharge nozzle upon activation by the motion sensing circuit.

3. The waste container of claim 1, wherein the liner chamber is detachable from the waste chamber.

4. The waste container of claim 1, said plurality of sequentially linked liners further comprising a stack of liners folded to at least partially overlap each other one to the next.

5. The waste container of claim 1, said plurality of sequentially linked liners further comprising a roll of liners connected one to the next and being separable along perforation tear lines.

6. The waste container of claim 1, wherein said liner chamber is positioned below said waste chamber.

* * * * *